US005130751A

United States Patent [19]

Sato et al.

[11] Patent Number: 5,130,751

[45] Date of Patent: Jul. 14, 1992

[54] ROTARY DRUM STRUCTURE IN AN IMAGE-FORMING MACHINE

[75] Inventors: Masaki Sato, Sakai; Seitaro Yoshida, Osaka, both of Japan

[73] Assignee: Mita Industrial Co., Ltd., Osaka, Japan

[21] Appl. No.: 724,854

[22] Filed: Jul. 2, 1991

[30] Foreign Application Priority Data

Jul. 9, 1990 [JP] Japan ..... 2-179661

[51] Int. Cl.[5] ..... G03G 15/00

[52] U.S. Cl. ..... 355/211; 439/11

[58] Field of Search ..... 355/211, 30; 219/469-471; 310/248; 439/11, 13, 27, 29

[56] References Cited

U.S. PATENT DOCUMENTS

| | | | |
|---|---|---|---|
| 3,136,590 | 7/1961 | Manson | 439/21 |
| 4,161,357 | 7/1979 | Herman et al. | 355/211 X |
| 4,319,825 | 3/1982 | Komori et al. | 355/30 X |
| 4,954,084 | 9/1990 | Pugh et al. | 439/29 |
| 4,975,743 | 12/1990 | Surti | 355/211 |
| 5,006,747 | 4/1991 | Stewart, Sr. | 310/248 X |

FOREIGN PATENT DOCUMENTS 57-161772 10/1982 Japan ..... 355/211

*Primary Examiner*—Joan H. Pendegrass

*Attorney, Agent, or Firm*—Beveridge, DeGrandi & Weilacher

[57] ABSTRACT

A drum support structure equipped with a rotary drum and a drum support shaft. The rotary drum includes a cylindrical main body with a photosenstive member disposed on the peripheral surface thereof, and a front flange and a rear flange fixed to the front end and rear end of the main body. A hollow grip case is fitted to the front end of the drum support shaft. In the hollow grip case are disposed a pair of electrode pieces and a resilient urging means that resiliently presses the electrode pieces onto the drum support shaft. The rear flange is made of an electrically conductive material, and the photosensitive member is grounded via the rear flange, drum support shaft and electrode pieces. In the rotary drum is disposed an electric heating means. A pair of electrode rings are fastened to the front flange by means of coupling fittings. The electric heating means is connected to the power source via the coupling fittings and electrode rings.

16 Claims, 5 Drawing Sheets

ROTARY DRUM STRUCTURE IN AN IMAGE-FORMING MACHINE

FIELD OF THE INVENTION

The present invention relates to a rotary drum structure in an electrostatic image-forming machine such as an electrostatic copying machine or an electrostatic printer.

DESCRIPTION OF THE PRIOR ART

A rotary drum structure is disposed in an electrostatic image-forming machine. In a typical example, the rotary drum structure is usually equipped with a rotary drum and a drum support shaft which rotatably supports the rotary drum at a required position. The rotary drum includes a cylindrical main body having a photosensitive member on the peripheral surface thereof, as well as a front flange and a rear flange that are respectively fixed to the front end and the rear end of the cylindrical main body. A shaft insertion hole is formed in each of the front flange and the rear flange. The drum support shaft is inserted in the shaft insertion holes formed in the front flange and rear flange of the rotary drum thereby to support the rotary drum. The front end and rear end of the drum support shaft protruding beyond the rotary drum are rotatably supported at required positions in the image-forming machine by a front bearing and a rear bearing. To the rear flange of the rotary drum is fastened an input gear which is drivingly coupled to a rotary driving source that may be an electric motor.

As is well known, it is important to ground the photosensitive member in order to form a good electrostatic latent image on the photosensitive member of the rotary drum and to develop the electrostatic latent image into a good toner image. As disclosed in, for example, Japanese Laid-Open Utility Model Publication No. 168759/1983, it has been proposed and placed in practice to form the drum support shaft using an electrically conductive material, to make at least either the front flange or the rear flange of the rotary drum out of an electrically conductive material, and to dispose an electrically conductive leaf spring with which comes in contact the rear end of the drum support shaft, whereby the photosensitive member is grounded via at least either the front flange or the rear flange, the drum support shaft and the leaf spring.

Formation of dew on the surface of the photosensitive member adversely affects the formation of the electrostatic latent image or the development thereof. Therefore, it has also been proposed and put into practice to arrange an electrically heating means within the cylindrical main body of the rotary drum. In this case, as disclosed in, for example, Japanese Laid-Open Patent Publication No. 161772/1982, at least either the front flange or the rear flange of the rotary drum is made of an electrically nonconductive material, electric connection means is disposed on either the front flange or the rear flange, another electric connection means is disposed on the drum support shaft to work in cooperation with the above electric connection means, and the above electric heating means is connected to the power source through these electric connection means.

As is widely known, the photosensitive member is contaminated or is deteriorated as it is used. Therefore, the rotary drum must be occasionally detached for cleaning or renewal. To detach the rotary drum, the drum support shaft must be pulled out from the rotary drum. On the other hand, to mount the rotary drum at a required position, the drum support shaft must be inserted in the rotary drum. In order that the drum support shaft can be conveniently pulled out or inserted, a grip case is usually fitted to the front end of the drum support shaft which is manipulated while gripping the grip case.

In order to maintain smooth rotation of the rotary drum, furthermore, it is desired that the drum support shaft is rotated together with the rotary drum. For this purpose, it is general that a so-called D-cut coupling (coupling arrangement in which the lateral cross section is not of a circular shape but is a D-shape that is formed by flattening part of a circle) is employed between the drum support shaft and the shaft insertion holes formed in the front and rear flanges.

However, the conventional rotary drum structure in the image-forming machine has the following problems that must be solved.

First, in the method of grounding the photosensitive member by bringing the rear end of the drum support shaft into contact with the leaf spring, the contact between the leaf spring and the rear end of the drum support shaft often becomes defective due to contamination by the toner used for the developing or by paper dust scattered from the transfer paper onto which the toner image is transferred from the photosensitive member. Furthermore, the contact often becomes defective due to vibration of the drum support shaft. When the defective contact occurs at the rear end of the drum support shaft, i.e. at the rear portion of the image-forming machine, difficulty is involved in carrying out the repairing or checking.

Second, it is desired to employ a particular grounding method for the front end of the drum support shaft from the standpoint of facilitating the repairing or checking of a defective contact in grounding of the photosensitive member. In this case, however, the required length of the drum support shaft is prolonged owing to employment of the particular grounding method, and so the image-forming machine tends to have a large size.

Third, since there are used considerably complex and expensive electric connection means which are disposed on the front or rear flange and on the drum support shaft in connection with the electric heating means that is disposed in the cylindrical main body of the rotary drum, efforts for reducing the size and decreasing the manufacturing cost could become useless.

Fourth, if the so-called D-cut coupling is employed to couple the rotary drum and the drum support shaft together, it becomes necessary to set the rotary drum and the drum support shaft at the determined angular positions relative to each other when the drum support shaft is inserted into the shaft insertion hole of the rotary drum. Consequently, insertion of the drum support shaft requires a cumbersome operation.

SUMMARY OF THE INVENTION

A first object of the present invention is to provide a rotary drum structure in an image-forming machine, in which the occurrence of defective grounding of the photosensitive member is fully avoided.

A second object of the present invention is to provide a rotary drum structure in an image-forming machine, in which employment of a particular method of grounding the photosensitive member does not need prolongation of the required length of the drum support shaft.

A third object of the present invention is to provide a rotary drum structure in an image-forming machine, in which a means for electrically connecting an electric heating means that is arranged in a cylindrical main body of the rotary drum is constructed very simply and at a reduced cost.

A fourth object of the present invention is to allow to couple the rotary drum and the drum support shaft together inhibiting rotation relative to each other without using the so-called D-cut coupling, and to insert the drum support shaft in the rotary drum without the need of setting the rotary drum and the drum support shaft at predetermined angles relative to each other.

Other objects of the present invention will become apparent from the following description taken in conjunction with the accompanying drawings.

According to one aspect of the present invention, there is provided a rotary drum structure in an image-forming machine which comprises a rotary drum having a photosensitive member on the peripheral surface thereof and a shaft insertion hole at the center thereof, and a drum support shaft that is inserted in the shaft insertion hole of the rotary drum to support the rotary drum and is rotatably supported at its front and rear ends protruding beyond the rotary drum by a front bearing member and a rear bearing member, wherein:

a hollow grip case is fitted to the front end of the drum support shaft to rotate relative to the rotary drum, and the drum support shaft is allowed to be inserted into the shaft insertion hole of the rotary drum from the rear end of the drum support shaft while gripping the grip case; and in the grip case are disposed at least one electrode piece which moves in a radial direction, as well as a resilient urging means which resiliently urges the electrode piece inwardly in the radical direction to press it onto the peripheral surface of the drum support shaft, and the photosensitive member is grounded via the drum support shaft and the electrode piece.

In the above rotary drum structure, the photosensitive member is grounded by utilizing the electrode piece that is pressed onto the drum support shaft, and defective grounding does not virtually occur or occurs very little. Furthermore, since the electrode piece and the resilient urging means thereof used for grounding the photosensitive member are accommodated in the grip case, the required length of the drum support shaft is not substantially prolonged despite the employment of the electrode piece and the resilient urging means thereof. Therefore, the above first object as well as the second object are accomplished by the above-mentioned rotary drum structure.

According to another aspect of the present invention, there is provided a rotary drum structure in an image-forming machine which comprises a rotary drum that includes a cylindrical main body with a photosensitive member on the peripheral surface thereof and a front flange and a rear flange fixed to the front end and the rear end of the cylindrical main body, each of the front flange and the rear flange having a shaft insertion hole formed at its central portion, and a drum support shaft that is inserted in the shaft insertion holes formed in the front flange and the rear flange of the rotary drum to support the rotary drum and is rotatably supported at its front and rear ends protruding beyond the rotary drum by a front bearing member and a rear bearing member, wherein:

at least one of the front flange and the rear flange is made of an electrically conductive member, provision is made of an electrode piece movably disposed in at least one guide path that outwardly extends in the radial direction from the peripheral surface of the drum support shaft and a resilient urging means which urges the electrode piece inwardly in the radial direction to press it onto the peripheral surface of the drum support shaft, and the photosensitive member is grounded by at least one of the front flange and the rear flange, the drum support shaft and the electrode piece.

In the above rotary drum structure of the invention, the photosensitive member is grounded by utilizing the electrode piece that is pressed onto the drum support shaft, and defective grounding does not virtually occur or occurs very little. Therefore, the above-mentioned first object is accomplished.

According to a further aspect of the present invention, there is provided a rotary drum structure in an image-forming machine which comprises a rotary drum that includes a cylindrical main body with a photosensitive member on the peripheral surface thereof and a front flange and a rear flange fixed to the front end and the rear end of the cylindrical main body, and an electric heating means disposed within the cylindrical main body of the rotary drum, at least one of the front flange and the rear flange being made of an electrically non-conductive material, wherein:

a pair of electrode rings are disposed maintaining a distance in the axial direction on the outside of either the front flange or the rear flange in the axial direction, the pair of electrode rings are fastened to either the front flange or the rear flange by coupling fittings made of an electrically conductive material that penetrates through either the front flange or the rear flange in the axial direction, and the electric heating means is connected to the power source via the coupling fittings and the electrode rings.

In the above rotary drum structure of the invention, the electric heating means is electrically connected to the power source by suitably utilizing the coupling fittings that couple the electrode rings to either the front flange or the rear flange, enabling the constitution related to the electric connection to be realized very simply and at a reduced cost and, hence, the aforementioned third object to be accomplished.

According to a still further aspect of the present invention, there is provided a rotary drum structure in an image-forming machine which comprises a rotary drum that includes a cylindrical main body with a photosensitive member on the peripheral surface thereof and a front flange and a rear flange fixed to the front end and the rear end of the cylindrical main body, the front flange and the rear flange having a shaft insertion hole formed at the central portions thereof, and a drum support shaft that is inserted in the shaft insertion holes formed in the front flange and the rear flange of the rotary drum to support the rotary drum and is rotatably supported at its front and rear ends protruding beyond the rotary drum via a front bearing member and a rear bearing member, wherein:

the front end of the drum support shaft are fitted with a press-contact member that does not rotate relative to the drum support shaft but moves in the axial direction over a predetermined range, and a resilient urging means that resiliently urges the press-contact member rearwardly; and when the drum support shaft is inserted from the rear end thereof in the shaft insertion holes formed in the front flange and rear flange of the rotary drum in order to support the rotary drum as required, the press-contact member of the drum support shaft is brought into pressed contact with the front flange of the rotary drum due to the resilient urging action of the resilient urging means.

In the above rotary drum structure of the invention, the press-contact member of the drum support shaft is brought into pressed contact with the front flange of the rotary drum, and the rotary drum and the drum support shaft are coupled to each other inhibiting the rotation relative to each other without using the so-called D-cut coupling. Therefore, the drum support shaft can be very easily inserted in the rotary drum without the need of setting the rotary drum and the drum support shaft at predetermined angles relative to each other, and the aforementioned fourth object is accomplished.

DETAILED DESCRIPTION OF PREFERRED EMBODIMENTS

Preferred embodiments of the invention will now be described in further detail with reference to the accompanying drawings.

Figure 1:
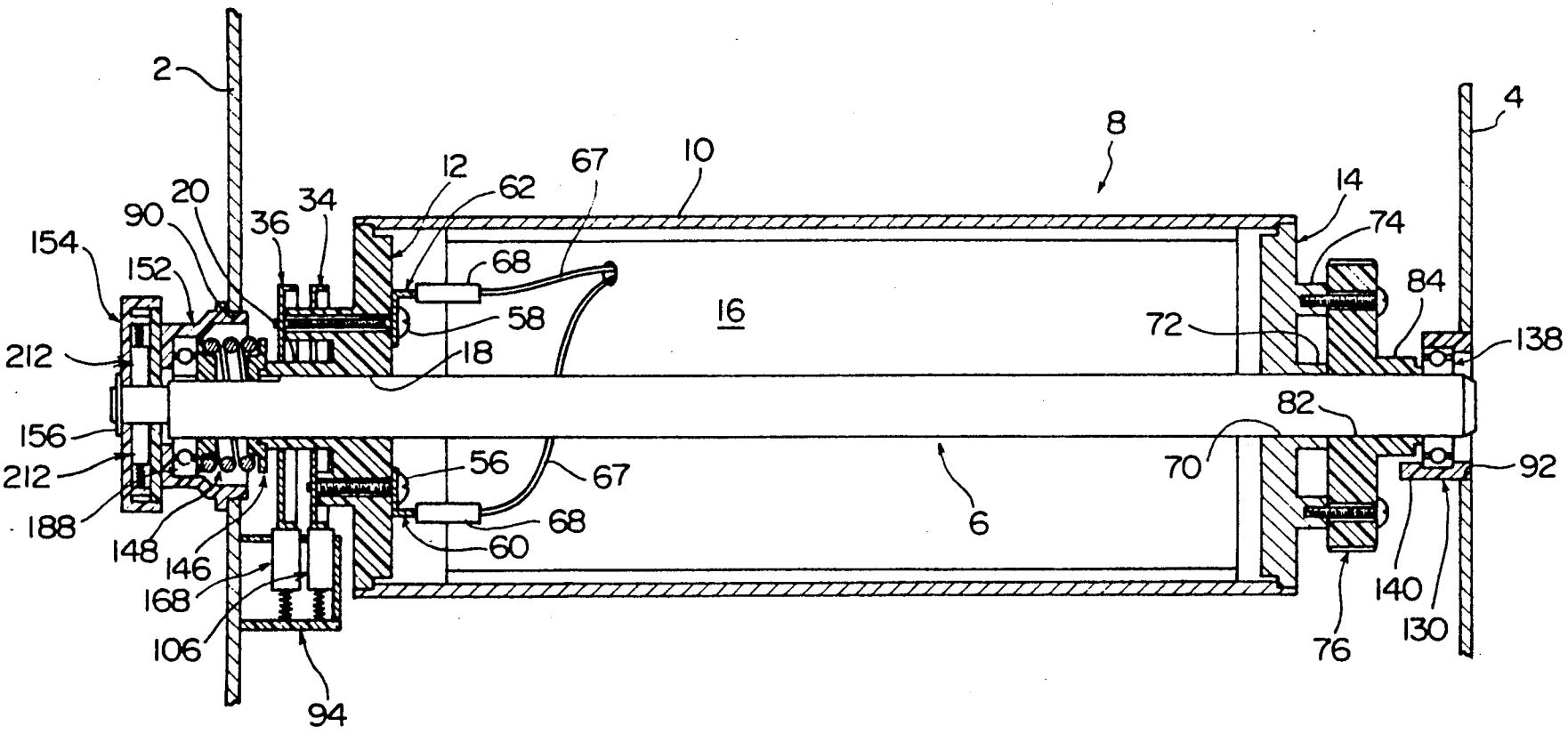
FIG. 1 is a sectional view showing an embodiment of a rotary drum structure constituted according to the present invention.

FIG. 1 shows the condition where a rotary drum 8 is mounted as required by a drum support shaft 6 between an erected front support plate 2 and an erected rear support plate 4 that are arranged at a distance in the back-and-fourth direction in an image-forming machine.

Figure 2:
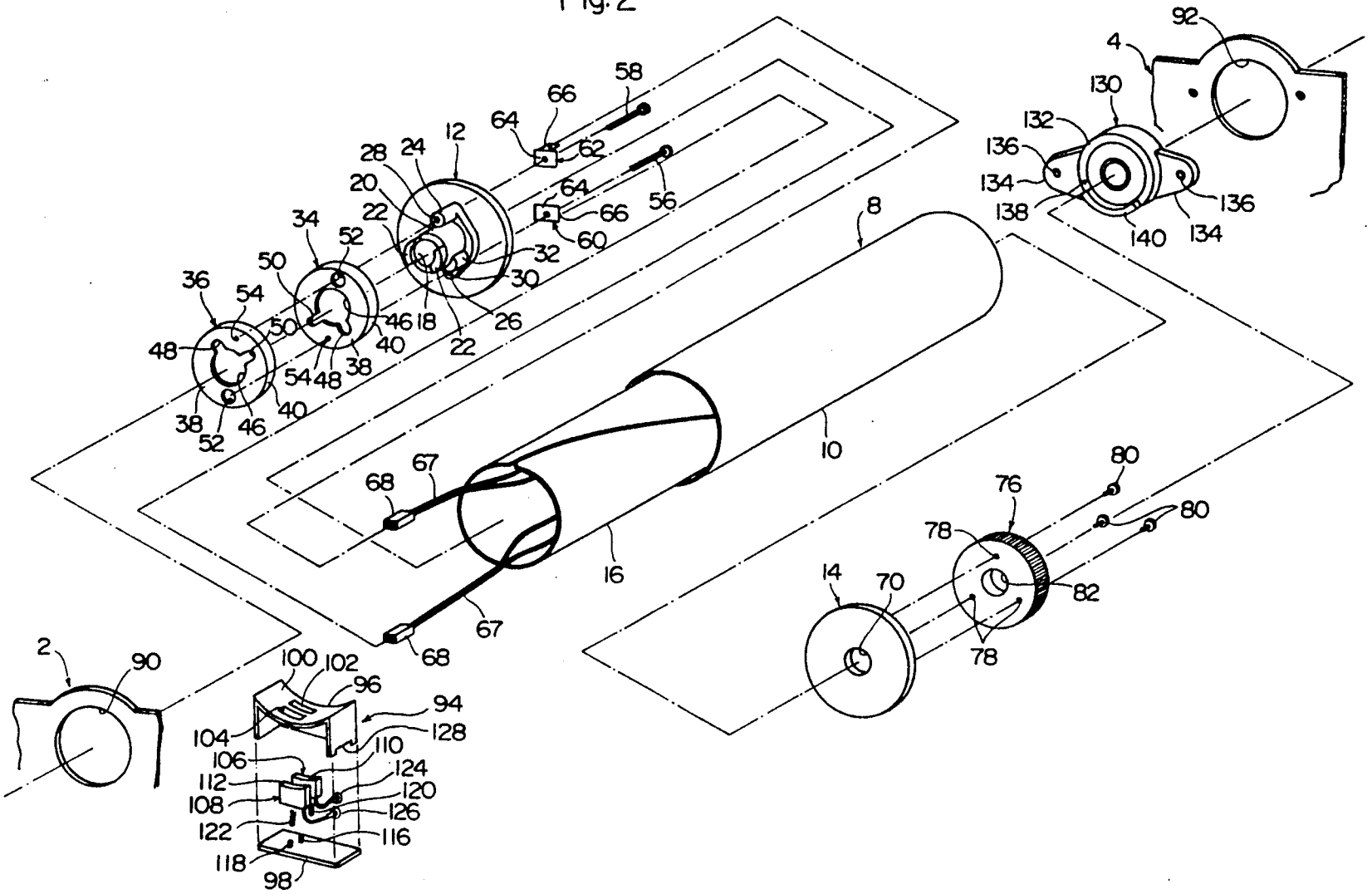
FIG. 2 is a disassembled perspective view showing a rotary drum and a temporary support means in the rotary drum structure of FIG. 1.
Figure 3:
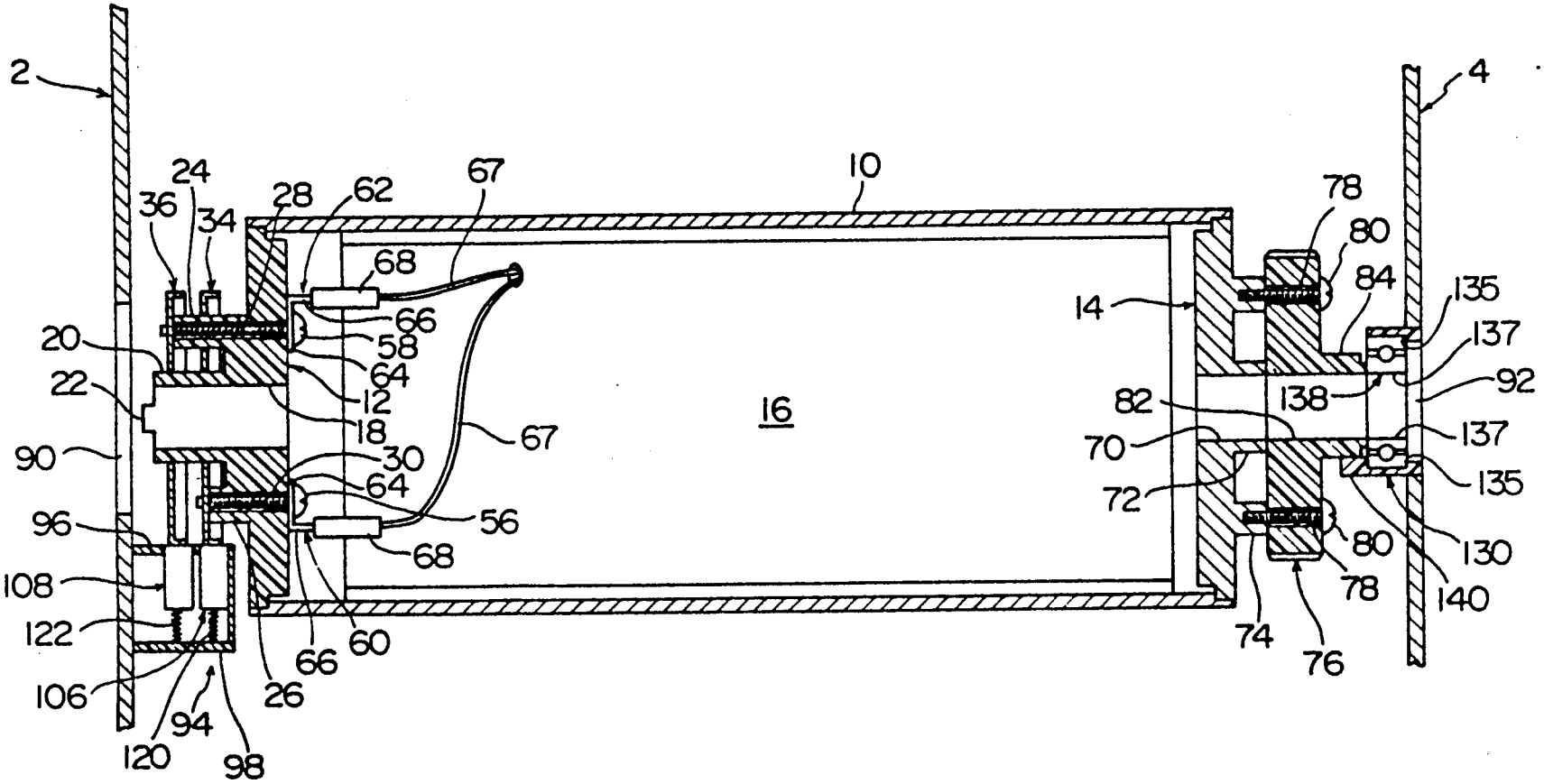
FIG. 3 is a sectional view showing the condition where the rotary drum is mounted on the temporary support means in the rotary drum structure of FIG. 1.

With reference to FIGS. 2 and 3 together with FIG. 1, the diagramed rotary drum 8 has a cylindrical main body 10 as well as a front flange 12 and a rear flange 14 fixed to the front end and the rear end of the cylindrical main body 10. The cylindrical main body 10 may be made of a suitable metal material such as aluminum and has an electrostatic photosensitive material that is applied to the peripheral surface thereof. As clearly diagramed in FIG. 2, furthermore, an electric heating means 16 which desirably has a cylindrical shape and which is widely known per se is disposed along the inner peripheral surface of the cylindrical main body 10.

The front flange 12 which has nearly a disk-like shape is made of an electrically nonconductive material which may be a synthetic resin. A circular shaft insertion hole 18 is formed at the central portion of the front flange 12. As clearly diagramed in FIG. 2, a forwardly protruded center hub 20 is formed on the front surface of the front flange 12. At the end of the cylindrical center hub 20 are formed two arcuate projections 22 maintaining a distance in the circumferential direction. The two projections 22 constitute an arcuate non-engaging means, as will be described later. On the front surface of the front flange 12 are further formed two cylindrical projections 24 and 26 that are located on the outside of the center hub 20 in the radial direction. The two cylindrical projections 24 and 26 are disposed at an angular distance of 180 degrees relative to each other, and one cylindrical projection 24 is protruded slightly longer than the other cylindrical projection 26. As will be apparent from FIG. 3, through holes 28 and 30 are formed at the centers of the two cylindrical projections 24 and 26 in the axial direction penetrating through the front flange 12. Moreover, two ridges 32 (FIG. 2 shows only one of them) are formed on the outer peripheral surface of the center hub 20 maintaining a suitable angular distance. The front flange 12 is fixed to the front end of the cylindrical main body 10 by such means as forced insertion, adhesion or screws. As clearly diagramed in FIGS. 2 and 3, two electrode rings 34 and 36 are fitted to the outer peripheral surface of the center hub 20 of the front flange 12 at a distance in the axial direction. In the diagramed embodiment, the electrode rings 34 and 36 are made in the same shape from the standpoint of saving the manufacturing cost. The electrode rings 34 and 36 are made of a suitable electrically conductive material such as copper and each has a disk-like portion 38 and an annular connection ring portion 40 that extends in the axial direction from the outer peripheral edge of the disk-like portion 38. An opening 46 is formed at the center of the disk-like portion 38 of the electrode rings 34 and 36. The opening 46 has two protruded portions 48 and 50 in addition to the main circular portion. The electrode rings 34 and 36 further have a circular opening 52 and a threaded hole 54 formed in the disk-like portions 38 thereof. As will be understood with reference to FIG. 3 together with FIG. 2, the electrode ring 34 is fitted onto the center hub 20 of the front flange 12 by permitting the center hub 20 of the front flange 12 to be inserted in the opening 46 formed at the center of the ring. Of the two cylindrical projections 24 and 26 of the front flange 12, one cylindrical projection 24 extends passing through the opening 52 of the electrode ring 34, while the other cylindrical projection 26 abuts at its tip on the inner surface of the disk-like portion of the electrode ring 34. The two ridges 32 formed on the outer peripheral surface of the center hub 20 protrude outwardly in the axial direction passing through the two protruded portions 48 and 50 of the opening 46 of the electrode ring 34. A set-screw 56 is inserted in the through hole 28 of the cylindrical projection 26, and the tip of the set-screw 56 is screwed into the threaded hole 54 of the electrode ring 34 so that the electrode ring 34 is fixed to a predetermined position. Similarly, the electrode ring 36 is fitted onto the center hub 20 of the front flange 12 by permitting the center hub 20 of the front flange 12 to be inserted in the opening 46 that is formed at the center of the electrode ring 36. The cylindrical projection 24 of the front flange 12 abuts at its tip on the inner surface of the disk-like portion of the electrode ring 36. A set-screw 58 is inserted in the through hole 30 of the cylindrical projection 24, and the tip of the set-screw 58 is screwed into the threaded hole 54 of the electrode ring 36 so that the electrode ring 36 is fastened to a predetermined position (since the electrode ring 36 has the same shape as the electrode ring 34, two protruded portions 48 and 50 are formed in the opening 46 of the electrode ring 36 and, further, an opening 52 is formed therein, but they are not needed for the electrode ring 36). On the inside of the front flange 12, as clearly diagramed in FIG. 2, the set-screws 56 and 58 are inserted in the holes formed in the connection terminal pieces 60 and 62, and are then inserted in the through holes 28 and 30 of the front flange 12, such that the connection terminal pieces 60 and 62 are fastened to the inner surface of the front flange 12 at a predetermined distance. The connection terminal pieces 60 and 62 are made of a suitable electrically conductive material such as copper, have nearly an L-shape, and further have fastening portions 64 with holes in which will be inserted the set-screws 56 and 58, as well as connection portions 66 that inwardly protrude in the axial direction from the fastening portions 64. As shown in FIG. 2, the electric heating means 16 disposed within the cylindrical main body 10 of the rotary drum 8 has two connection wires 67 and connection plugs 68 attached to the ends of the connection wires 67. The connection portions 66 of the connection terminal pieces 60 and 62 are inserted in and connected to the connection plugs 68. It is important that the set-screws 56 and 58 are made of an electrically conductive metal, and that the electric heating means 16 disposed inside the front flange 12 is electrically connected to the electrode rings 34 and 36 fitted onto the outside of the front flange 12 via connection terminal pieces 60, 62 and set-screws 56, 58 (the electrode rings 34 and 36 are connected to the power source as will be described later, and thus, the electric heating means 16 is connected to the power source).

As for electrical connection of the electric heating means 16 as described above, attention should be given to the fact that the set-screws 56 and 58 that couple the electrode rings 34 and 36 to the front flange 12 are advantageously utilized for accomplishing the electric connection from the inside to the outside of the front flange 12, which contributes to greatly simplifying the structure and reducing the cost compared with the conventional method for electric connection. The diagramed embodiment has used the set-screws 56 and 58 as coupling fittings for coupling the electrode rings 34 and 36 to the front flange 12. As required, furthermore, it is allowable to use any other coupling means such as bolts and nuts, and in such a case, the coupling means is made of an electrically conductive material to accomplish the electric connection to the electric heating means 16. Though the electric heating means 16 is connected to the power source via the front flange 12, it is also possible to connect the electric heating means 16 to the power source via the rear flange 14 instead of the front flange 12.

Description is further continued with reference to FIGS. 2 and 3. The rear flange 14 of the rotary drum 8 has nearly a disk-like shape and is made of an electrically conductive material such as aluminum. A circular shaft insertion hole 70 is formed at the center of the rear flange 14. On the back (outer) surface of the rear flange 14 are disposed a center hub 72 that protrudes rearwardly and an annular ridge 74 that is formed concentrically on the outside of the hub in the radial direction. The center hub 72 and the annular ridge 74 protrude substantially by the same amount in the axial direction. The above rear flange 14 is fastened inside the rear end of the cylindrical main body 10 by such means as forced insertion, adhesion or screws. An input gear 76 is secured to the back surface of the rear flange 14. The input gear 76 has three through holes 78 formed maintaining suitable angular distances, and is fixed to the rear flange 14 by screwing the set-screws 80 into the threaded holes formed in the annular ridge 74 of the rear flange 14 through the through holes 78. A shaft insertion hole 82 is formed at the center of the input gear 76. On the back surface of the input gear 76 is formed a center hub 84 that rearwardly protrudes. As the rotary drum 8 is rotatably mounted at a required position in the image-forming machine as will be described later, the input gear 76 is brought into engagement with a driving gear (not shown) arranged in the image-forming machine, and the rotary drum 8 is drivably coupled to a rotary driving source (not shown) that may be an electric motor.

The description is further continued with reference to FIGS. 2 and 3. The erected front support plate 2 and the erected rear support plate 4 are disposed in the image-forming machine maintaining a distance to each other as mentioned earlier. In the front support plate 2 and the rear support plate 4 are formed circular mounting openings 90 and 92 in alignment with each other in the axial direction. A front bearing case (which will be described later in detail) is fitted to the mounting opening 90 formed in the front support plate 2. Further, a temporary support means 94 is fastened to the inner surface of the front support plate 2 just under the mounting opening 90. The temporary support means 94 is constituted by a box 96 having open front surface and open bottom surface, and a bottom plate 98. The box 96 is fastened to the inner surface of the front support plate 86 by suitable means such as screws, and the bottom plate 98 is fastened to the lower surface of the box 96 by suitable means such as screws. The upper surface of the box 96 assumes an arcuate concave surface 100. The curvature of the arcuate concave surface 100 corresponds to the curvature of the annular connection ring portions 40 of the electrode rings 34 and 36. Two openings 102 and 104 are formed in the arcuate concave surface 100 of the box 96, maintaining a distance in the axial direction. In the openings 102 and 104 are inserted the electrode pieces 106 and 108 that is made of carbon and can move up and down. As will become apparent from the description appearing later, the openings 102 and 104 define guide paths that outwardly extend from the peripheral surfaces of the electrode rings 34 and 36 (i.e., from the outer peripheral surfaces of the annular connection ring portions 40) in the radial direction, and the electrode pieces 106 and 108 are allowed to move along the above guide paths. The upper surfaces of the electrode pieces 106 and 108, too, assume arcuate concave surfaces 110 and 112 having substantially the same curvature as the arcuate concave surface 100. Small projections 116 and 118 are formed on the upper surface of the bottom plate 98 to upwardly protrude in correspondence to the above two openings 102 and 104, and compression coil springs 120 and 122 are fitted to these small projections 116 and 118. The compression coil springs 120 and 122 that constitute the resilient urging means that acts upon the electrode pieces 106 and 108, work to resiliently urge the electrode pieces 106 and 108 upwardly. The electrode pieces 106 and 108 are partly and upwardly protruded through the openings 102 and 104. To the electrode pieces 106 and 108 are fastened connection terminal wires 124 and 126 that outwardly extend through an opening 128 fromed in the side wall of the box 96. The connection terminal wires 124 are connected to a power source circuit (not shown) of the image-forming machine via suitable connection wires (not shown). As the rotary drum 8 is rotatably mounted at a required position as will be described later in detail, the electrode pieces 106 and 108 are pressed onto the outer peripheral surfaces of annular connection ring portions 40 of the electrode rings 34 and 36 due to the resilient urging action of the compression coil springs 120 and 122, whereby the electrode rings 34 and 36 are connected to the power source circuit via electrode pieces 106 and 108.

A rear bearing case 130 is fitted to the mounting opening 92 that is formed in the rear support plate 4. The rear bearing case 130 has a cylindrical main portion 132 and two protruded pieces 134 that outwardly protrude in the radial direction from the rear end of the main portion 132. The rear bearing case 130 is inserted with its main portion 132 in the mounting opening 92 from the front side, and is fixed to a predetermined position by screwing set-screws (not shown) into the rear support plate 4 through holes 136 that are formed in the protruded pieces 134. In the main portion 132 of the rear bearing case 130 is forcibly inserted a bearing member 138 that may consist of ordinary ball bearings having an outer race 135 and an inner race 137. In the diagramed embodiment, the rear bearing case 130 has an arcuate protrusion that is formed integrally therewith to forwardly protrude from the lower half portion at the front end of the main portion 132. The arcuate protrusion constitutes a temporary support means 140 and a curvature of the upper surface thereof corresponds to the curvature of the outer peripheral surface of the center hub 84 that is formed on the input gear 76 of the rotary drum 8.

Next, a drum support shaft 6 will be described with reference to FIGS. 4 and 5 together with FIG. 1. The drum support shaft 6 is made of a suitable electrically conductive material such as a stainless steel and assumes the shape of a round rod that extends slenderly in the axial direction. The outer diameter of the main portion of drum support shaft 6 corresponds to (or is substantially the same as or is slightly smaller than) the inner diameter of the shaft insertion holes 18, 70 and 82 of the rotary drum 8. The rear end of the drum support shaft 6 has the shape of a circular truncated cone that becomes narrow toward the tip thereof. A small-diameter front end portion 142 is formed at the front end of the drum support shaft 6 having a diameter slightly smaller than that of the main portion. An annular groove 144 is formed at the front end of the small-diameter front end portion 142. At the front end of the main portion continuous to the small-diameter front end portion 142, the peripheral surface is flattened over a predetermined angular portion to form a D-shape in cross section (so-called D-cut). To the front end of the drum support shaft 6 are fitted a press-contact member 146, a resilient urging means 148, an additional press-contact member 150, a front bearing case 152, a grip case 154 and a C-ring 156 in the order mentioned.

Figure 4:
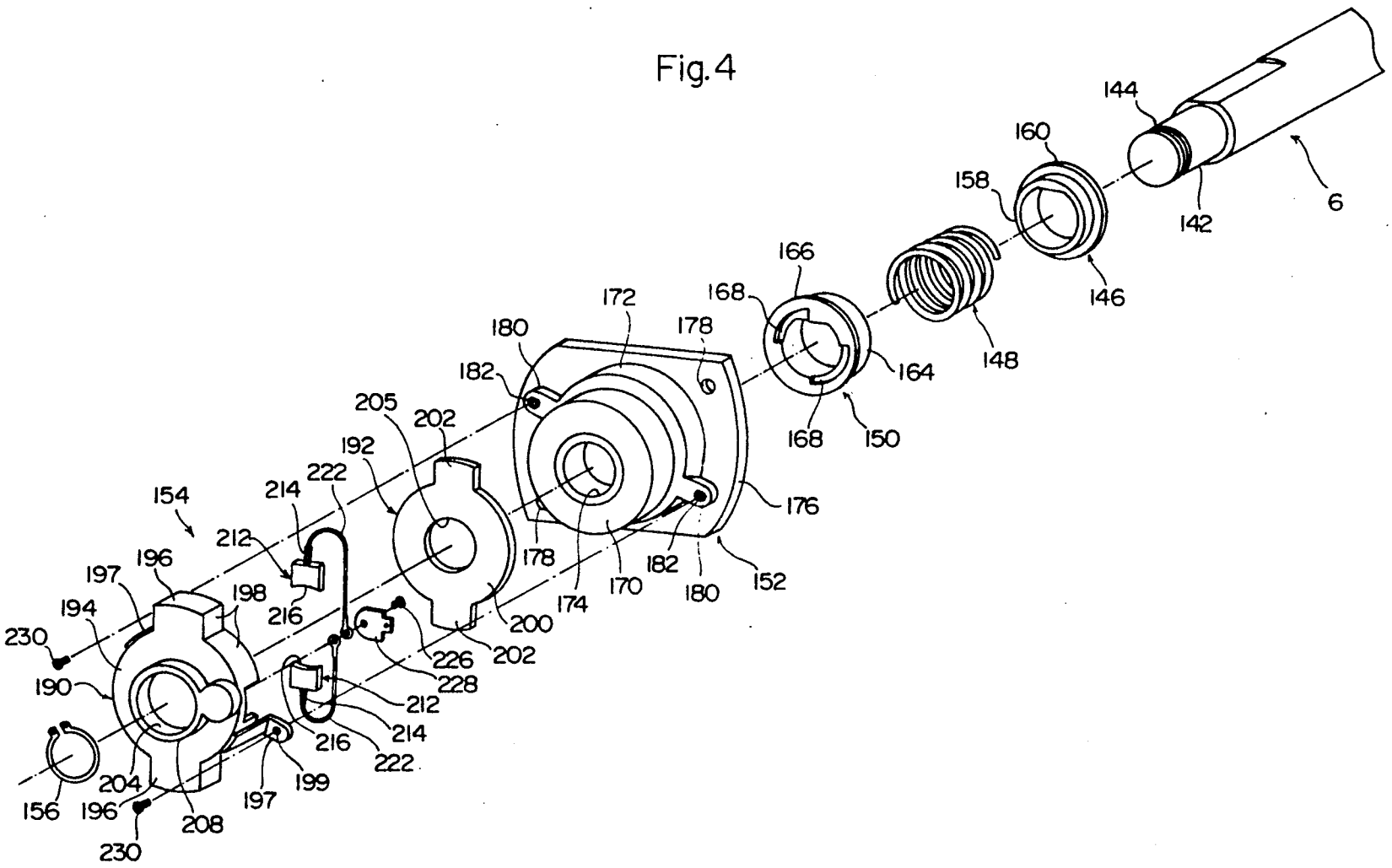
FIG. 4 is a disassembled perspective view showing a drum support shaft and constituent elements mounted thereon in the rotary drum structure of FIG. 1.
Figure 5:
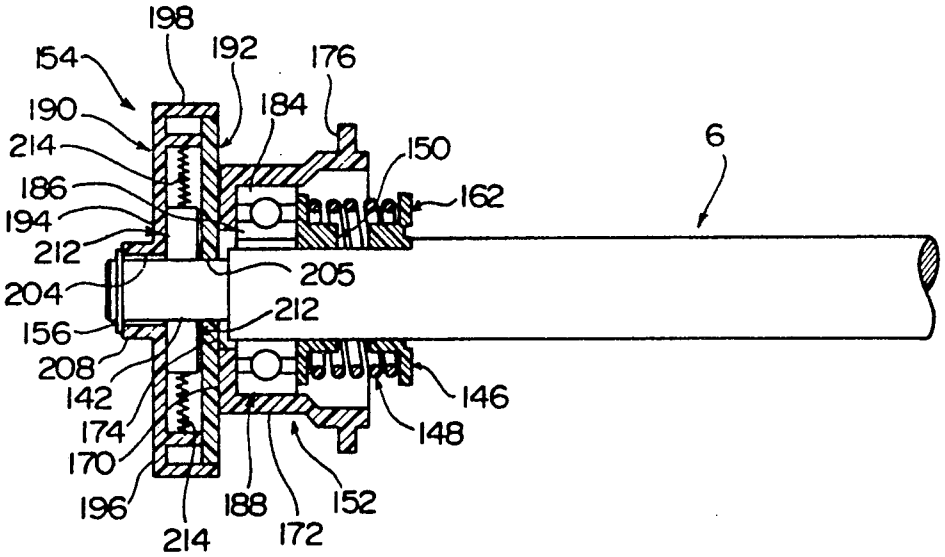
FIG. 5 is a sectional view showing the drum support shaft and constituent elements mounted thereon in the rotary drum structure of FIG. 1.

With reference to FIGS. 4 and 5, the press-contact member 146 that can be made of a suitable synthetic resin has a cylindrical portion 158 and an extended flange 160 that outwardly extends in the radial direction from the rear end of the cylindrical portion 158. The inner peripheral surface of the cylindrical portion 158 is flattened over a predetermined angular portion; i.e., the through opening of the cylindrical portion 158 has a D-shape in cross section to correspond to the D-shape in cross section of the front end of the main portion of the drum support shaft 6. In the back surface of the press-contact member 146 ar formed two arcuate notches 162 maintaining a distance in the circumferential direction (see arcuate engaging notches 168 formed in the front surface of the additional press-contact member 150 that are clearly diagramed in FIG. 4). The notches 162 constitute an arcuate engaging means as will become apparent from the description appearing later. The distance in the circumferential direction between the two arcuate notches 162 corresponds to the distance in the circumferential direction between the two arcuate nonengaging projections 22 formed at the end of the center hub 20 of the front flange 12 in the rotary drum 8 (i.e., the former distance is substantially the same as or is slightly greater than the latter distance). The resilient urging means 148 is constituted by a compression coil spring. The inner diameter of the compression coil spring is nearly equal to the outer diameter of the cylindrical portion 158 of the press-contact member 146. The additional press-contact member 150 has quite the same shape as the press-contact member 146, but is used front side back. Therefore, the additional press-contact member 150 that can be made of a suitable synthetic resin, too, has a cylindrical portion 164 and an extended flange 166 that outwardly extends in the radial direction from the front end of the cylindrical portion 164. The inner peripheral surface of the cylindrical portion 164 is flattened over a predetermined angular portion. Therefore, the through opening of the cylindrical portion 164 has a D-shape in cross section that corresponds to the D-shape in cross section of the front end of the main portion of drum support shaft 6. Two arcuate notches 168 are formed in the rear surface of the additional press-contact member 150 maintaining a distance in the circumferential direction.

Further description will be made with reference to FIGS. 4 and 5. The front bearing case 152 that can be made of a suitable synthetic resin has a circular front wall 170 and a cylindrical side wall 172 that rearwardly extends from the front wall 170. A circular opening 174 is formed in the center of the front wall 170. The central portion in the axial direction of the side wall 172 has the shape of a circular truncated cone that extends rearwardly, while outwardly tilting, in the radial direction. Therefore, the inner diameter of the front end of the side wall 172 is slightly smaller than the inner diameter of the rear end. At the rear end of the side wall 172 is formed a flange 176 that outwardly extends in the radial direction. The extended flange 176 has two holes 178 formed maintaining an angular distance of 180 degrees. Furthermore, on the front surface of the extended flange 176 are formed protruded portions 180 that outwardly protrude in the radial direction from the side wall 172 at an angular distance of 180 degrees. A threaded hole 182 is formed in each of the protruded portions 180 to extend from the front surface thereof toward the rear side. As clearly diagramed in FIG. 5, in the front portion of the front bearing case 152 is forcibly inserted a bearing member 188 which may be an ordinary ball bearing having an outer race 184 and an inner race 186.

Figure 6:
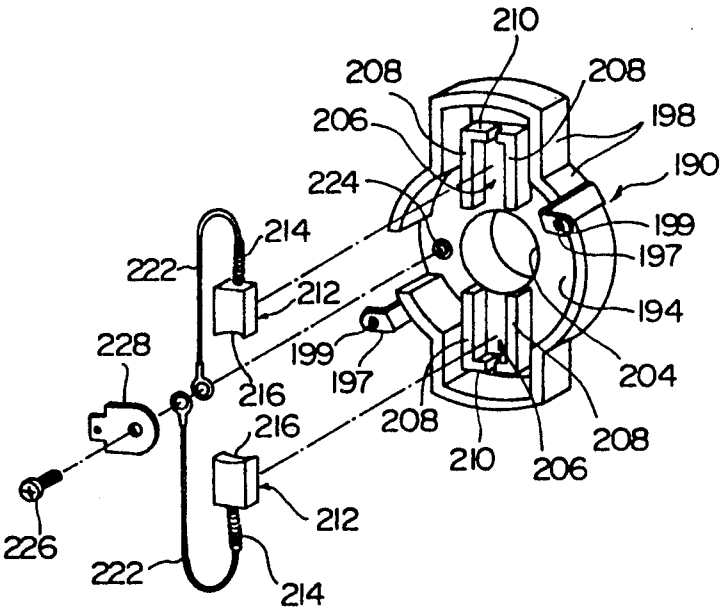
FIG. 6 is a disassembled perspective view showing a grip case fitted to the drum support shaft in the rotary drum structure of FIG. 1.

With reference to FIG. 6 together with FIGS. 4 and 5, the grip case 154 is constituted by a case body 190 and a plate member 192. The case body 190 that can be made of a suitable synthetic resin is a hollow one having a surface, i.e., having a rear surface that is open, and includes a front wall that has a central circular portion 194 and protruded portions 196 protruding upwards and downwards from the central circular portion 194, as well as a side wall 198 that wearwardly extends from the front wall. The case body 190 further has coupling portions 197 that are formed at two angular positions maintaining an angular distance of 180 degrees relative to each other, and that extend rearwardly and then outwardly in the radial direction. The coupling portions 197 have a hole 199 formed in the end that extends in the radial direction. The plate member 192 that can similarly be made of a suitable synthetic resin has a circular portion 200 and protruded portions 202 that protrude upwardly and downwardly from the circular portion 200. As diagramed in FIG. 5, the plate member 192 is fastened to the rear surface of the case body 190 by a suitable means such as adhesion or set-screws thereby to close the rear surface of the case body 190. A center opening 204 is formed in the cylindrical portion of the case body 190 and, similarly, a center opening 205 is formed in the circular portion of the plate member 192. The inner diameters of the center openings 204 and 205 correspond to the outer diameter of the small-diameter front end portion 142 of the drum support shaft 6 (or are substantially the same or are slightly greater). An annular projection 208 is formed on the front wall of the case body 190 forwardly protruding from the peripheral edge of the center opening 204. As clearly diagramed in FIG. 6, two guide grooves 206 are formed in the case body 190 extending, respectively, upwards and downwards from the center opening 204 in relation to the two protruded portions 196. The guide grooves 206 are defined by guide walls 208 that extend in parallel with each other, and have closing end walls 210 formed at the upper end and lower end thereof. In the guide grooves 206 are accommodated the electrode pieces 212 and resilient urging means 214. The electrode piece 212 that can be made of a material such as carbon or the like has an arcuate contact surface 216. The curvature of the arcuate contact surface 216 corresponds to the curvature of the peripheral surface of the small-diameter front end portion 142 of the drum support shaft 6. The resilient urging means 214 is constituted by the compression coil spring that is fitted to the connection terminal wire 222. One end of the resilient urging means 214 comes into contact with the electrode piece 212 and the other end thereof comes into contact with the end wall 210 of the guide groove 206. Thus, the resilient urging means 214 resiliently urges the electrode piece 212 inwardly in the radial direction. A connection terminal piece 228 is fastened into the case body 190 by screwing a set-screw 226 into a threaded hole 224 formed at a required position in the inner surface of the front wall. The end of the connection terminal wire 222 of the electrode piece 212 is connected to the connection terminal piece 228. The grip case 154 accommodating the electrode piece 212, resilient urging means 214 and connection terminal piece 228, is fixed to the front surface of the front bearing case 152 by screwing the set-screws 230 into the threaded holes 182 formed in the extended flange 176 of the front bearing case 152 through holes 199 formed in the coupling portion 197 of the case body 190.

As clearly diagramed in FIG. 5, the press-contact member 146, resilient urging means 148 and additional press-contact member 150 are fitted to the front end that has a D-shape in cross section of the main portion of the drum support shaft 6. Through openings of the press-contact member 146 and additional press-contact member 150 have a corresponding D-shape in cross section. Therefore, the press-contact member 146 and additional press-contact member 150 are mounted on the drum support shaft 6 without permitted to rotate relative to the drum support shaft 6. The resilient urging means 148 is fitted to both the cylindrical portion 158 of the press-contact member 146 and the cylindrical portion 164 of the additional press-contact member 150, and resiliently urges the press-contact member 146 and the additional press-contact member 150 to separate away from each other in the axial direction. The front bearing case 152 is mounted on the drum support shaft 6 spanning across the small-diameter front end portion 142 of the drum support shaft 6 and the front end of the main portion, and the front end of the main portion of drum support shaft 6 is supported by the bearing member 188. The grip case 154 fastened to the front surface of the front bearing case 152 surrounds the small-diameter front end portion 142 of the drum support shaft 6. The front bearing case 152 and the grip case 154 are allowed to rotate relative to the drum support shaft 6. The electrode pieces 212 disposed in the grip case 154 are pressed onto the outer peripheral surface of the small-diameter front end portion 142 of the drum support shaft 6 by the action of the resilient urging means 214. The C-ring 156 that can be made of a suitable metallic material is fitted to the annular groove 144 formed in the small-diameter front end portion of the drum support shaft 6, whereby the grip case 154, front bearing case 152 and additional press-contact member 150 are prevented from escaping forward from the drum support shaft 6. By the action of the resilient urging means 148 interposed between the press-contact member 146 and the additional press-contact member 150, therefore, the press-contact member 146 is pressed onto the rearmost end having a D-shape in cross section of the main portion of drum support shaft 6, the additional press-contact member 150 is pressed onto the bearing member 188 in the front bearing case 152, and the front bearing case 152 and the grip case 154 are pressed onto the C-shaped ring 156.

The drum support shaft 6 having the press-contact member 146, resilient urging means 148, additional press-contact member 150, front bearing case 152, grip case 154 and C-ring 156 that are mounted as required, is inserted into the rotary drum 8 from the rear end thereof while gripping the grip case 154. As diagramed in FIG. 1, the main portion of the drum support shaft 6 is inserted into the shaft insertion hole 82 of the input gear 76 of the rotary drum 8, the shaft insertion hole 70 of the rear flange 14 and the shaft insertion hole 18 of the front flange 12. The rear end of the rotary drum 8, i.e., the rear end of the drum support shaft 6 that rearwardly protrudes beyond the input gear 76 is inserted in the bearing member 138 that is accommodated in the rear bearing case 130 mounted on the rear support plate 4, and is thus supported. The front bearing case 152 fitted to the front end of the drum support shaft 6 is mounted on the mounting opening 90 that is formed in the front support plate 2. As will be easily understood with reference to FIGS. 4 and 5 together with FIG. 1, the rear end of side wall 172 of the front bearing case 152 is inserted in the mounting opening 90, the extended flange 176 thereof is brought in contact with the front surface of the front support plate 2, the set-screw (not shown) is screwed into the front support plate 2 through the hole 178 formed in the extended flange 176, whereby the front bearing case 152 is secured to the front support plate 2. Thus, the drum support shaft 6 is supported at its front end by the bearing member 188 mounted on the front support plate 2, and is supported at its rear end by the bearing member 138 mounted on the rear support plate 4, in order to support the rotary drum 8. As will be easily understood from the comparison of FIG. 1 with FIG. 3, when the drum support shaft 6 is inserted into the rotary drum 8 as described above to support the rotary drum 8 as required, the rotary drum 8 is slightly raised above the temporary support means 94 and 140 so that it is separated away from the temporary support means 94 and 140. The electrode pieces 106 and 108 disposed in the temporary support means 94 of the front side are raised according to the rise of the rotary drum 8 being resiliently urged by the compression coil springs 120 and 122, and are thus maintained in sufficiently good contact with the electrode rings 34 and 36 that are arranged in the rotary drum 8.

When the rotary drum 8 is mounted as shown in FIG. 1, the photosensitive member put onto the peripheral surface of the cylindrical main body 10 of the rotary drum 8 is connected to the connection terminal piece 228 that is disposed in the grip case 154 via the drum support shaft 6 which is made of an electrically conductive material and electrode pieces 212 disposed in the grip case 154 (from this point of view, it is important that the drum support shaft 6 is fully intimately inserted in the shaft insertion hole 70 of the rear flange 14 so that they are brought into contact with each other fully intimately). The connection terminal piece 228 disposed in the grip case 154 is connected to a grounding portion in the image-forming machine via a suitable connection wire (not shown), and the photosensitive member is thus grounded in a particular and excellent manner by utilizing the electrode pieces 212 that are pressed onto the peripheral surface of the drum support shaft 6. Therefore, there does not virtually develop the probability of so-called defective connection. Furthermore, the electrode pieces 212, resiliently urging means 212 and connection terminal piece 228 used for the grounding are accommodated in the grip case 154 of the drum support shaft 6. Employment of this particular and excellent grounding method does not cause the required length of the drum support shaft 6 to be made greatly longer. In addition, this grounding system accomplished at the front end of the drum support shaft 6 by utilizing the electrode pieces 212 can be very easily repaired or checked by pulling out the drum support shaft 6 from the rotary drum 8.

In regard to mounting the rotary drum 8, attention should be given to the following fact. When the rotary drum 8 is mounted as shown in FIG. 1, the press-contact member 146 (which is not allowed to rotate relative to the drum support shaft 6) mounted on the drum support shaft 6 is pressed onto the center hub 20 formed on the front flange 12 of rotary drum 8 by the action of the resilient urging means 148 mounted on the drum support shaft 6. Furthermore, the center hub 84 of the input gear 76 fitted to the rearmost portion of the rotary drum 8 is pressed onto the inner race 137 of the bearing member 138 accommodated in the rear bearing case 130 by the resilient urging force given to the rotary drum 8 from the resilient urging means 148. Thus, the rotary drum 8 and the drum support shaft 6 rotate as a unitary manner. When the rotary drum 8 and the drum support shaft 6 rotate relative to each other by a considerably great force exerted thereto, the press-contact member 146 mounted on the drum support shaft 6 and the center hub 20 of front flange 12 of the rotary drum 8 rotate relative to each other. Then, the arcuate projections 22 formed at the front end of the center hub 20 are positioned between the two arcuate notches 162 formed in the rear surface of the press-contact member 146. Then, the press-contact member 146 resiliently moves rearwardly in the axial direction, whereby the press-contact member 146 and the front flange 12 are firmly coupled together by the notches 162 and projections 22 that work in cooperation. Thus, the rotary drum 8 and the drum support shaft 6 are reliably prevented from rotating relative to each other.

Though an embodiment of the present invention was described above in detail in conjunction with the accompanying drawings, it should be noted that the present invention is in no way limited to the above embodiment only but can be altered or modified in a variety of other ways without departing from the scope of the present invention.

What we claim is:

1. A rotary drum structure in an image-forming machine which comprises a rotary drum having a photosensitive member on the peripheral surface thereof and a shaft insertion hole at the center thereof, and a drum support shaft that is inserted in said shaft insertion hole of said rotary drum to support said rotary drum and is rotatably supported at its front and rear ends which protrude beyond said rotary drum by a front bearing member and a rear bearing member, wherein:

a hollow grip case is fitted to the front end of said drum support shaft, and said drum support shaft is allowed to be inserted into said shaft insertion hole of said rotary drum from the rear end of the drum support shaft;

in said grip case are disposed at least one electrode piece which moves in a radial direction, as well as a resilient urging means which resiliently urges said electrode piece inwardly in the radial direction to press it onto the peripheral surface of said drum support shaft, and the photosensitive member is grounded via said drum support shaft and said electrode piece; and a front bearing case is provided which holds said front bearing member that rotatably supports the front end of said drum support shaft, said front bearing case is secured to a predetermined position in the image-forming machine, and said grip case is secured to said front bearing case.

2. A rotary drum structure according to claim 1, wherein said rotary drum includes a cylindrical main body on which said photosensitive member is disposed and a front flange and a rear flange that are fixed, respectively, to the front end and the rear end of said cylindrical main body, said shaft insertion hole is formed in each of said front flange and said rear flange, at least one of said front flange and said rear flange is made of an electrically conductive material, and said photosensitive member is grounded by at least one of said front flange and said rear flange via said drum support shaft and said electrode piece.

3. A rotary drum structure according to claim 1, wherein said grip case includes a case body of which the one surface is open and a plate member that is combined with said case body to close said one surface, center openings are formed in said case body and said plate member such that said drum support shaft is inserted therein, at least one guide groove that outwardly extends in the radial direction from said center opening is formed in said case body, and said electrode piece and said resilient urging means are accommodated in said guide groove.

4. A rotary drum support structure according to claim 3, wherein two of said guide grooves are formed in said grip case body, said two guide grooves being opposed to each other in the direction of diameter thereof, and said electrode piece and said resilient urging means are accommodated in each of said guide grooves.

5. A rotary drum structure in an image-forming machine which comprises a rotary drum that includes a cylindrical main body with a photosensitive member on the peripheral surface thereof and a front flange and a rear flange fixed to the front end and the rear end of said cylindrical main body, and an electric heating means disposed within said cylindrical main body of said rotary drum, at least one of said front flange and said rear flange being made of an electrically nonconductive material, wherein:

a pair of electrode rings are disposed maintaining a distance in the axial direction on the outside of either said front flange or said rear flange in the axial direction, said pair of electrode rings are fastened to either said front flange or said rear flange by coupling fittings made of an electrically conductive material that penetrate through either said front flange or said rear flange in the axial direction, and said electric heating means is connected to the power source via said coupling fittings and said electrode rings.

6. A rotary drum structure according to claim 5, wherein a center hub is formed on either said front flange or said rear flange to protrude in the axial direction, and said pair of electrode rings are fitted to said hub.

7. A rotary drum structure according to claim 6, wherein said coupling fitting is a set-screw of which the end portion is screwed into said electrode ring.

8. A rotary drum structure according to claim 5, wherein a pair of connection terminal pieces are disposed on the inside of either said front flange or said rear flange in the axial direction, said connection terminal pieces being fastened by said coupling fittings.

9. A rotary drum structure according to claim 5, wherein provision is made of a pair of electrode pieces that are movably disposed in the guide paths which outwardly extend in the radial direction from the peripheral surfaces of said electrode rings, and a resilient urging means that resiliently urges said electrode pieces inwardly in the radial direction to press said electrode pieces onto the peripheral surfaces of the electrode rings, and said electric heating means is connected to the power source via said electrode rings and said electrode pieces.

10. A rotary drum structure according to claim 9, wherein a front temporary support means and a rear temporary support means are disposed to support the front end and the rear end of said rotary drum, a shaft insertion hole is formed at the centers of said front flange and said rear flange of said rotary drum, said rotary drum is placed on said front temporary support means and said rear temporary support means, a drum support shaft is inserted in said shaft insertion hole, and the front end and the rear end of said drum support shaft protruding beyond said rotary drum are rotatably supported via the front bearing member and the rear bearing member, whereby said rotary drum is slightly lifted by said drum support shaft and is rotatably supported being upwardly slightly separated above said front temporary support means and said rear temporary support means, and wherein said guide paths are formed in either said front temporary support means or said rear temporary support means.

11. A rotary drum structure in an image-forming machine which comprises a rotary drum that includes a cylindrical main body with a photosensitive member on the peripheral surface thereof and a front flange and a rear flange fixed to the front end and the rear end of said cylindrical main body, said front flange and said rear flange having a shaft insertion hole formed at the central portions thereof, and a drum support shaft that is inserted in said shaft insertion holes formed in said front flange and said rear flange of said rotary drum to support said rotary drum and is rotatably supported at its front and rear ends which protrude beyond said rotary drum via a front bearing member and a rear bearing member, wherein:

the front end of said drum support shaft is fitted with a press-contact member that does not rotate relative to the drum support shaft but moves in the axial direction over a predetermined range, and a resilient urging means that resiliently urges said press-contact member rearwardly;

when said drum support shaft is inserted from the rear end thereof in said shaft insertion holes formed in said front flange and said rear flange of said rotary drum to support said rotary drum, the press-contact member of said drum support shaft is brought into pressed contact with said front flange of said rotary drum due to the resilient urging action of said resilient urging means; and a center hub is formed on said front flange of said rotary drum to forwardly protrude in the axial direction, and said press-contact member of said drum support shaft is brought in pressed contact with said center hub.

12. A rotary drum structure according to claim 11, wherein at least one arcuate non-engaging means is formed on the front end surface of said center hub, and at least one arcuate engaging means capable of engaging with said non-engaging means if formed on the rear end surface of said press-contact member.

13. A rotary drum structure in an image-forming machine which comprises a rotary drum that includes a cylindrical main body with a photosensitive member on the peripheral surface thereof and a front flange and a rear flange fixed to the front end and the rear end of said cylindrical main body, said front flange and said rear flange having a shaft insertion hole formed at the central portions thereof, and a drum support shaft that is inserted in said shaft insertion holes formed in said front flange and said rear flange of said rotary drum to support said rotary drum and is rotatably supported at its front and rear ends which protrude beyond said rotary drum via a front bearing member and a rear bearing member, wherein:

the front end of said drum support shaft is fitted with a press-contact member that does not rotate relative to the drum support shaft but moves in the axial direction over a predetermined range, and a resilient urging means that resiliently urges said press-contact member rearwardly;

when said drum support shaft is inserted from the rear end thereof in said shaft insertion holes formed in said front flange and said rear flange of said rotary drum to support said rotary drum, the press-contact member of said drum support shaft is brought into pressed contact with said front flange of said rotary drum due to the resilient urging action of said resilient urging means; and a front bearing case that is located in front of said press-contact member is fitted to said drum support shaft to rotate relative to said drum support shaft, an outer race of said front bearing member is fastened inside said bearing case that is secured to a predetermined position, and said resilient urging means has a compression spring that is interposed between said press-contact member and an inner race of said front bearing member.

14. A rotary drum structure according to claim 13, wherein an additional press-contact member is disposed between said inner race of said front bearing member and said compression spring.

15. A rotary drum structure in an image-forming machine which comprises a rotary drum that includes a cylindrical main body with a photosensitive member on the peripheral surface thereof and a front flange and a rear flange fixed to the front end and the rear end of said cylindrical main body, said front flange and said rear flange having a shaft insertion hole formed at the central portions thereof, and a drum support shaft that is inserted in said shaft insertion holes formed in said front flange and said rear flange of said rotary drum to support said rotary drum and is rotatably supported at its front and rear ends which protrude beyond said rotary drum via a front bearing member and a rear bearing member, wherein:

the front end of said drum support shaft is fitted with a press-contact member that does not rotate relative to the drum support shaft but moves in the axial direction over a predetermined range, and a resilient urging means that resiliently urges said press-contact member rearwardly;

when said drum support shaft is inserted from the rear end thereof in said shaft insertion holes formed in said front flange and said rear flange of said rotary drum to support said rotary drum, the press-contact member of said drum support shaft is brought into pressed contact with said front flange of said rotary drum due to the resilient urging action of said resilient urging means; and an outer race of said rear bearing member is secured to a predetermined position, an input gear is fastened to the rear surface of said rear flange of said rotary drum, a center hub is formed on said input gear to protrude rearwardly, and said center hub of said input gear is brought in pressed contact with an inner race of said rear bearing member being resiliently urged by said resilient urging means that acts on said rotary drum via said press-contact member.

16. A rotary drum structure according to claim 15, wherein said outer race of said rear bearing member is fixed to the rear bearing case, and said rear temporary support means is formed on said rear bearing case.

* * * * *